US009944502B2

(12) United States Patent
Yamashita

(10) Patent No.: US 9,944,502 B2
(45) Date of Patent: Apr. 17, 2018

(54) CYLINDER RETRACTION SYSTEM, BOOM DEVICE AND CRAWLER CRANE

(71) Applicant: Hitachi Sumitomo Heavy Industries Construction Crane Co., Ltd., Taitou-ku, Tokyo (JP)

(72) Inventor: Tomoaki Yamashita, Obu (JP)

(73) Assignee: Hitachi Sumitomo Heavy Industries Construction Crane Co., Ltd., Tokyo (JP)

( * ) Notice: Subject to any disclaimer, the term of this patent is extended or adjusted under 35 U.S.C. 154(b) by 0 days.

(21) Appl. No.: 15/361,270

(22) Filed: Nov. 25, 2016

(65) Prior Publication Data

US 2017/0073200 A1 Mar. 16, 2017

Related U.S. Application Data

(63) Continuation of application No. 14/226,202, filed on Mar. 26, 2014, now abandoned.

(30) Foreign Application Priority Data

Mar. 29, 2013 (JP) ..... 2013-073302

(51) Int. Cl.
*B66C 23/36* (2006.01)
*B66C 23/62* (2006.01)
*B66C 9/00* (2006.01)

(52) U.S. Cl.
CPC ..... *B66C 23/365* (2013.01); *B66C 9/00* (2013.01); *B66C 23/62* (2013.01)

(58) Field of Classification Search
CPC ..... B66C 23/365; B66C 9/00; B66C 23/62
See application file for complete search history.

(56) References Cited

U.S. PATENT DOCUMENTS 2,741,373 A * 4/1956 Edgar ..... B66C 13/18 212/302
3,306,470 A * 2/1967 Green ..... B66C 23/70 212/300
3,732,988 A * 5/1973 Lamer ..... B66C 23/702 212/300

(Continued)

FOREIGN PATENT DOCUMENTS

JP 2006-56695 A 3/2006

*Primary Examiner* — Michael E Gallion
(74) *Attorney, Agent, or Firm* — Crowell & Moring LLP

(57) ABSTRACT

A cylinder retraction system causes a crawler side frame hoisting hydraulic cylinder, swingably suspended on a ventral surface side of a lower boom, to swing between a retracted attitude, in which the hydraulic cylinder is set along a ventral surface of the lower boom, and an operating attitude, in which the hydraulic cylinder is oriented along a vertical direction. As the rod of the hydraulic cylinder, currently having the operating attitude, is contracted by a predetermined extent, the rod front end of the hydraulic cylinder is guided by the guiding portion until the hydraulic cylinder takes on the retracted attitude. As the hydraulic cylinder, currently having the retracted attitude, is extended by a predetermined extent, engagement between the rod front end of the hydraulic cylinder and the guiding portion is released so as to allow the hydraulic cylinder to take on the operating attitude.

2 Claims, 16 Drawing Sheets

(56) References Cited

U.S. PATENT DOCUMENTS 3,874,532 A * 4/1975 Metailler ..... B66C 23/36 37/403
3,912,088 A * 10/1975 Bronfman ..... B66C 13/06 212/260
4,258,852 A * 3/1981 Juergens ..... B66C 23/74 212/178
4,266,679 A * 5/1981 Juergens ..... B66C 23/78 180/9.1
4,290,731 A * 9/1981 Griffith ..... B60P 3/28 212/177
4,358,021 A * 11/1982 Helm ..... B66C 23/36 212/195
4,892,202 A * 1/1990 Hey ..... B66C 23/52 212/232
4,946,051 A * 8/1990 Cliff ..... B66C 23/64 212/258
5,480,041 A * 1/1996 Turner ..... B66C 23/06 212/273
5,598,935 A * 2/1997 Harrison ..... B62D 49/085 180/69.1
5,960,970 A * 10/1999 Walker ..... B66C 23/36 212/294
6,039,194 A * 3/2000 Beeche ..... B66C 23/20 180/411
6,062,405 A * 5/2000 Pech ..... B66C 23/36 212/298
6,481,202 B1 * 11/2002 Zuehlke ..... B66C 23/36 212/299
6,669,038 B1 * 12/2003 Zingerman ..... B66C 23/62 212/232
6,702,132 B1 * 3/2004 Moore ..... B66C 23/62 212/175
7,032,289 B2 4/2006 Oliver et al.
7,290,671 B2 * 11/2007 Kimura ..... B66C 23/62 212/175
8,684,197 B2 * 4/2014 Pech ..... B66C 23/348 212/260
8,727,145 B2 * 5/2014 Zollondz ..... B62D 21/186 180/9.48
9,206,021 B2 * 12/2015 Kurotsu ..... B66C 23/66
2007/0221600 A1 * 9/2007 Davis ..... B66C 23/36 212/270
2008/0264887 A1 10/2008 Porubcansky
2009/0289495 A1 * 11/2009 Zollondz ..... B62D 21/186 305/120
2010/0072155 A1 * 3/2010 Foust ..... B66C 23/365 212/175
2010/0072156 A1 * 3/2010 Mentink ..... B66C 23/365 212/196
2010/0276385 A1 * 11/2010 Pech ..... B66C 23/348 212/237
2012/0152878 A1 * 6/2012 Ishihara ..... B66C 23/365 212/280
2014/0291267 A1 * 10/2014 Yamashita ..... B66C 23/365 212/180

* cited by examiner

CYLINDER RETRACTION SYSTEM, BOOM DEVICE AND CRAWLER CRANE

CROSS REFERENCE TO RELATED APPLICATIONS

This application is a continuation of U.S. patent application Ser. No. 14/226,202, filed Mar. 26, 2014, the entire disclosure of which is expressly incorporated herein by reference, and which claims priority to Japanese Patent Application No. 2013-073302, filed Mar. 29, 2013.

INCORPORATION BY REFERENCE

The disclosure of the following priority application is herein incorporated by reference: Japanese patent application No. 2013-073302 filed Mar. 29, 2013

BACKGROUND OF THE INVENTION

1. Field of the Invention

The present invention relates to a cylinder retraction system, a boom device and a crawler crane.

2. Description of Related Art

Japanese Laid Open Patent Publication No. 2006-56695 discloses a crawler crane equipped with a self mount/dismount device that allows a crawler to be self mounted/dismounted during an assembly/disassembly process. The self mount/dismount device performs a crawler self mount/dismount operation by using sheaves disposed at a lower boom and a hoisting device installed at a revolving upper superstructure.

However, the self mount/dismount device disclosed in the publication cited above requires a rope to be wound around the various sheaves at the lower boom and a heavy hook prior to the crawler mount/dismount operation and this preparatory work is both time-consuming and labor intensive.

As a way of addressing this issue, a cylinder-type self mount/dismount device, having a hydraulic cylinder swingably suspended in advance on the ventral surface side of the lower boom so as to allow the crawler to mount or dismount itself via the hydraulic cylinder, has been proposed. When the hydraulic cylinder is not in use in a crawler crane equipped with the cylinder-type self mount/dismount device, the hydraulic cylinder is held by connecting the front end of a rod, located at the lower end of the suspended hydraulic cylinder, with the lower boom via a belt sling, a rope sling or the like and keeping the rod in the hydraulic cylinder in the contracted state. When the hydraulic cylinder needs to be used, the rod is extended and the sling is taken off.

SUMMARY OF THE INVENTION

In the crawler crane equipped with the cylinder-type self mount/dismount device, a certain degree of slack is allowed at the sling holding the hydraulic cylinder and the hydraulic cylinder is held with the lower end thereof somewhat set apart from the lower boom. It is to be noted that the sling is held with a certain degree of slack, as described above, because if the hydraulic cylinder is set to range closely along the ventral surface of the lower boom by applying a large tensile force to the sling, the hydraulic cylinder, the sling and the like would be placed under an excessive load, and the likelihood of damage to connecting areas at the lower boom where it connects with the hydraulic cylinder, the sling and the like.

As described above, at the crawler crane equipped with the cylinder-type self mount/dismount device, the lower end of the hydraulic cylinder suspended at the lower boom is set over some distance from the lower boom, and this gives rise to a concern that depending upon the crane work attitude, the hook or the hoisting rope from which the hook is suspended may interfere with the hydraulic cylinder during crane operation.

A cylinder retraction system, according to a first aspect of the present invention, that causes a crawler side frame hoisting hydraulic cylinder, swingably suspended on a ventral surface side of a lower boom, to swing between a retracted attitude, in which the hydraulic cylinder is set along a ventral surface of the lower boom, and an operating attitude in which the hydraulic cylinder is oriented along a vertical direction, comprises: a guide portion that engages with a rod front end of a rod of the hydraulic cylinder so as to guide the rod front end of the hydraulic cylinder as the rod of the hydraulic cylinder extends or contracts, with a base end of the guide portion attached to the ventral surface side of the lower boom and a front end of the guide portion set away from the ventral surface of the lower boom, wherein: as the rod of the hydraulic cylinder, currently having the operating attitude, is contracted by a predetermined extent, the rod front end of the hydraulic cylinder is guided by the guiding portion until the hydraulic cylinder takes on the retracted attitude, whereas as the hydraulic cylinder, currently having the retracted attitude, is extended by a predetermined extent, engagement between the rod front end of the hydraulic cylinder and the guiding portion is released so as to allow the hydraulic cylinder to take on the operating attitude.

According to a second aspect of the present invention, in the cylinder retraction system according to the first aspect, it is preferable that the base end of the guiding portion is axially supported on a side where the lower boom is present, the guiding portion is allowed to rotate between a retracted position, at which the front end of the guiding portion is set in close proximity to the lower boom, and an operating position, at which the front end of the guiding portion is set apart from the ventral surface of the lower boom.

According to a third aspect of the present invention, in the cylinder retraction system according to the first or second aspect, it is preferable that the guiding portion is provided as a pair of guiding portions set apart from each other over a predetermined distance on two opposite sides of the rod; a shaft member, disposed at the rod front end at the hydraulic cylinder, ranges so as to bridge over the pair of guiding portions; and the guiding portions are structured so that as the rod contracts, the hydraulic cylinder swings toward the ventral surface of the lower boom with the shaft member guided by the pair of guiding portions.

A boom device according to a fourth aspect of the present invention comprises: a lower boom rotatably mounted at a revolving upper superstructure; and the crawler side frame hoisting hydraulic cylinder and the cylinder retraction system according to any one of the first to third aspects.

A crawler crane according to a fifth aspect of the present invention comprises: the boom device according to the fourth aspect; and a hydraulic circuit via which pressure oil is supplied to the crawler side frame hoisting hydraulic cylinder.

DESCRIPTION OF PREFERRED EMBODIMENT

The following is a description of an embodiment of a crawler crane according to the present invention, given in reference to drawings.

Figure 1:
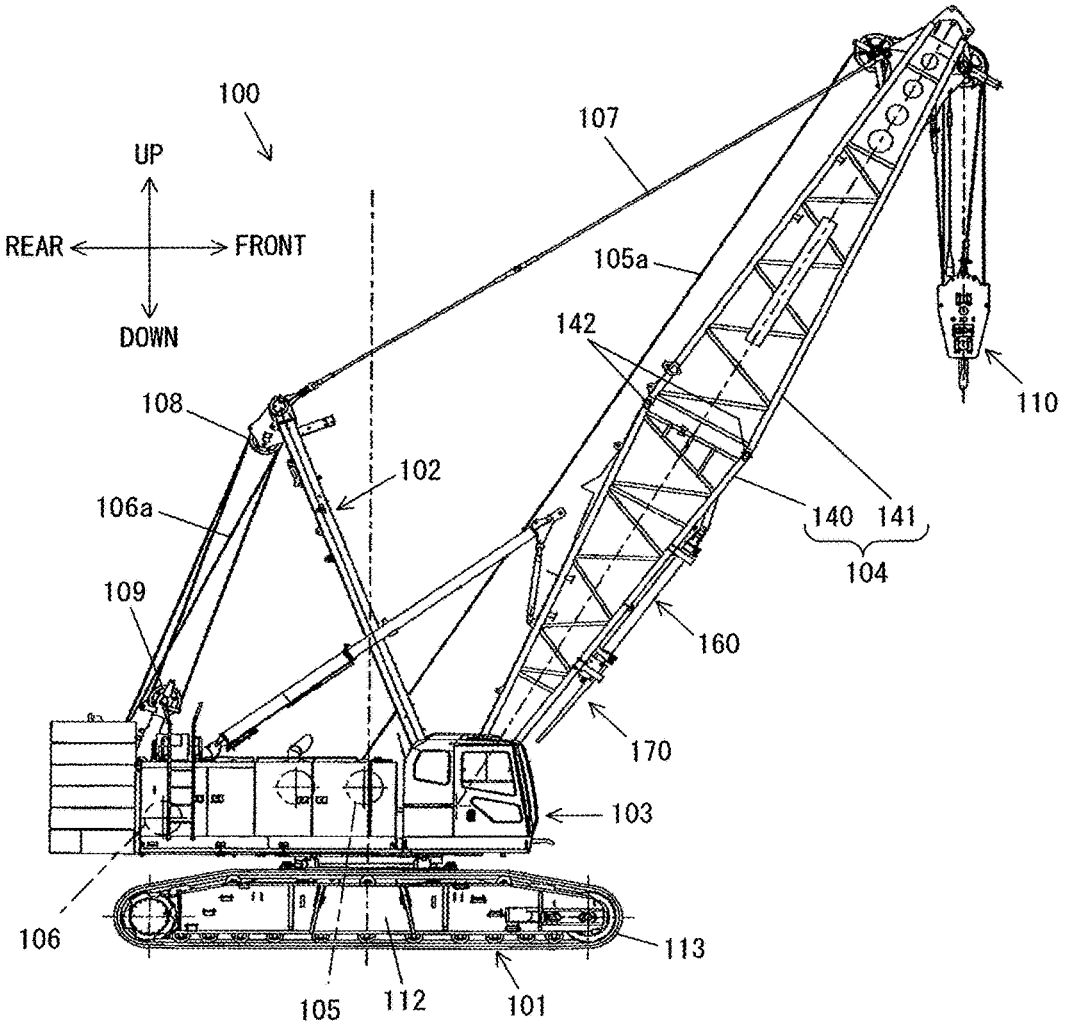
FIG. 1 is a side elevation, providing an external view of a crawler crane achieved in an embodiment.

FIG. 1 is a side elevation, providing an external view of the crawler crane achieved in the embodiment of the present invention. The crawler crane (hereafter simply referred to as the crane 100) includes a traveling lower superstructure 101, a revolving upper superstructure 103 rotatably disposed upon the traveling lower superstructure 101 via a revolving bearing, and a boom 104, a base end portion of which is pivotably attached to the revolving upper superstructure 103.

The traveling lower superstructure 101 includes a car body 111 (see FIG. 2) linked to the revolving upper superstructure 103 and a pair of crawlers detachably mounted on the two sides of the car body 111. The crawlers are each configured so as to include a crawler side frame 112 and a crawler track (or crawler belt) 113 wrapped around the crawler side frame 112.

The boom 104 includes a lower boom 140 and an upper boom 141. The lower boom 140 and the upper boom 141 are coupled with each other at a coupling portion 142 and can be separated from each other at the coupling portion 142. At the revolving upper superstructure 103, a hoisting winch 105 at which a hoisting rope 105*a* is wound and a derricking winch 106 at which a derricking rope 106*a* is wound are mounted.

The hoisting rope 105*a* is connected to a hook 110 via sheaves disposed at the front end of the boom 104, and the hook 110 moves up/down as the hoisting winch 105 is driven. One end of a pendant rope 107 is connected to the front end of the boom 104, whereas another end of the pendant rope 107 is connected to an upper spreader 108.

The derricking rope 106*a* is wound around a plurality of times so as to run between the upper spreader 108 located at the top of a mast 102 and a lower spreader 109. As the derricking winch 106 is driven, the distance between the lower spreader 109 and the upper spreader 108 changes, and the boom 104 is thereby driven up/down.

A hydraulic circuit 200 (see FIG. 2) that supplies pressure oil to the various winches and traveling motors used to drive the crawlers and to a crawler side frame hoisting hydraulic cylinder 160, configuring a crawler side frame mount/dismount device, which will be described in detail later, is installed in the crane 100. An operator's cab is located at the revolving upper superstructure 103, and an operator operates a plurality of operation members disposed within the operator's cab to operate the derricking winch 106, the hoisting winch 105, the revolving upper superstructure 103 and the traveling lower superstructure 101 when engaging the crane in work such as lifting/lowering a suspended load. It is to be noted that an operation member operated to extend/contract the crawler side frame hoisting hydraulic cylinder 160 is also disposed in the operator's cab.

In order to stay within the dimensional limits and the weight limits imposed when the crane 100 is transported on a trailer or the like, the crawler side frames 112 are designed as detachable crawler side frames that can be attached to and detached from the car body 111. The crane 100 achieved in the embodiment includes a crawler side frame mount/dismount device that allows the crane to mount/dismount the crawler side frames 112 by itself. The crawler side frame mount/dismount device is configured with the hydraulic cylinder 160 used to hoist up the crawler side frames 112 and a cylinder retraction system 170 engaged in an operation for retracting the hydraulic cylinder 160 during the preparatory work performed prior to mounting/dismounting the crawler side frames 112 and after the mounting/dismounting operation for the crawler side frames 112 is completed.

Figure 2:
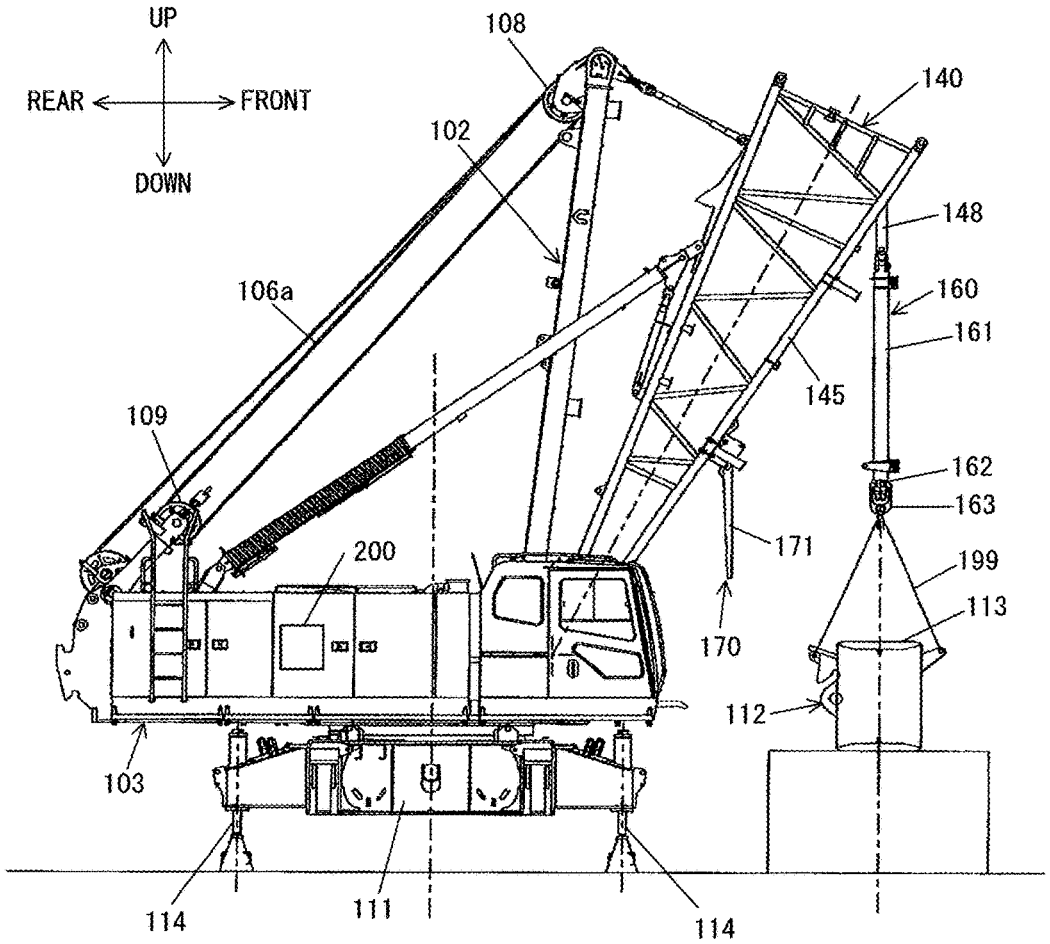
FIG. 2 presents an example of a crawler side frame mounting operation that may be performed by using a crawler side frame mount/dismount device.

FIG. 2 presents an example of a mounting operation that may be performed when mounting a crawler side frame 112 with the crawler side frame mount/dismount device. As shown in FIG. 2, the hydraulic cylinder 160, used to hoist up the crawler side frame 112, is swingably suspended on the ventral surface side of the lower boom 140. The hydraulic cylinder 160, which includes a cylinder tube 161 and a rod 162, is disposed so that the upper end of the cylinder tube 161 is attached to the ventral surface side of the lower boom 140 and the front end of the rod 162 is set at the lower end of the hydraulic cylinder 160.

When mounting the crawler side frame 112 at the car body 111, hydraulic jack cylinders (or jack-up cylinders) 114 disposed at the car body 111 are extended, as illustrated in FIG. 2, to jack up the body and the revolving upper superstructure 103 is rotated by 90° relative to the car body 111.

Figure 3:
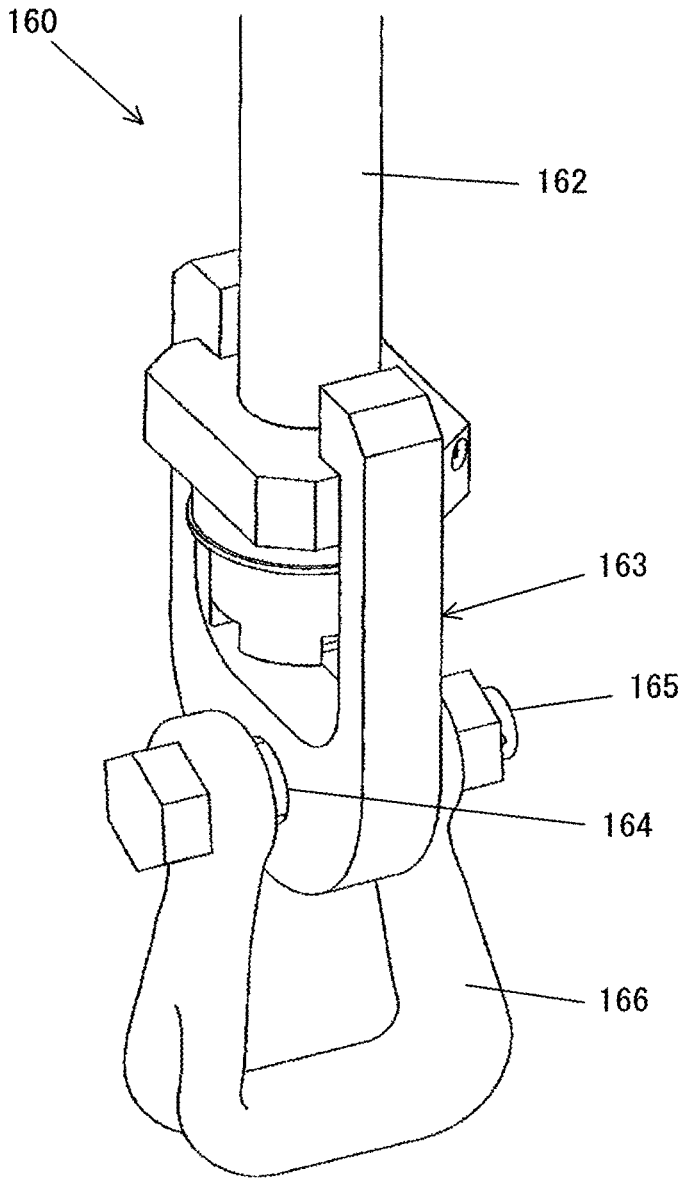
FIG. 3 shows the front end of a rod in a hydraulic cylinder.

The rod 162 in the hydraulic cylinder 160 is extended and a suspension rope 199 is attached to the front end of the rod 162 in the extended state. FIG. 3 shows the front end of the rod 162 in the hydraulic cylinder 160. As shown in FIG. 3, a mounting fixture 163 with a through hole 164 formed thereat is attached to the front end of the rod 162. The operator inserts a bolt 165 through the through hole 164 at the mounting fixture 163 and through a shackle 166 so as to attach the shackle 166 to the mounting fixture 162. The operator then fastens the suspension rope 199 to the shackle 166.

As FIG. 2 illustrates, the suspension rope 199 is attached to the crawler side frame 112 and then the rod 162 in the hydraulic cylinder 160 is made to contract so as to hoist up the crawler side frame 112. The boom 104 is then raised further upright and the rod 162 is extended so as to move the crawler side frame 112 closer to the car body 111 until the crawler side frame 112 reaches a predetermined mounting position. The crawler side frame 112 is then locked onto the car body 111 via pins and bolts, and thus, the mounting process for the crawler side frame 112 is completed. The crawler side frame 112 on the other side is mounted through a similar procedure. Subsequently, the jack-up cylinders 114 are contracted, the crawler tracks 113 are lowered to the ground and thus, the overall mounting operation for the crawler side frames 112 is completed.

After the crawler side frames 112 are mounted, the upper boom 141 is connected to the lower boom 140, the hoisting rope 105*a* is wound through at the sheaves at the front end of the upper boom 141, the hook 110 is connected to the front end of the hoisting rope 105*a* and the crane 100 thus assumes its work attitude. As FIG. 1 shows, when the crane 100 assumes the work attitude, the hydraulic cylinder 160, set so as to range along the ventral surface side of the lower boom 140, assumes the retracted attitude. The hydraulic cylinder 160 in the retracted state never interferes with the hoisting rope 105*a* or the hook 110 while the crane is engaged in work operation.

Figure 4:
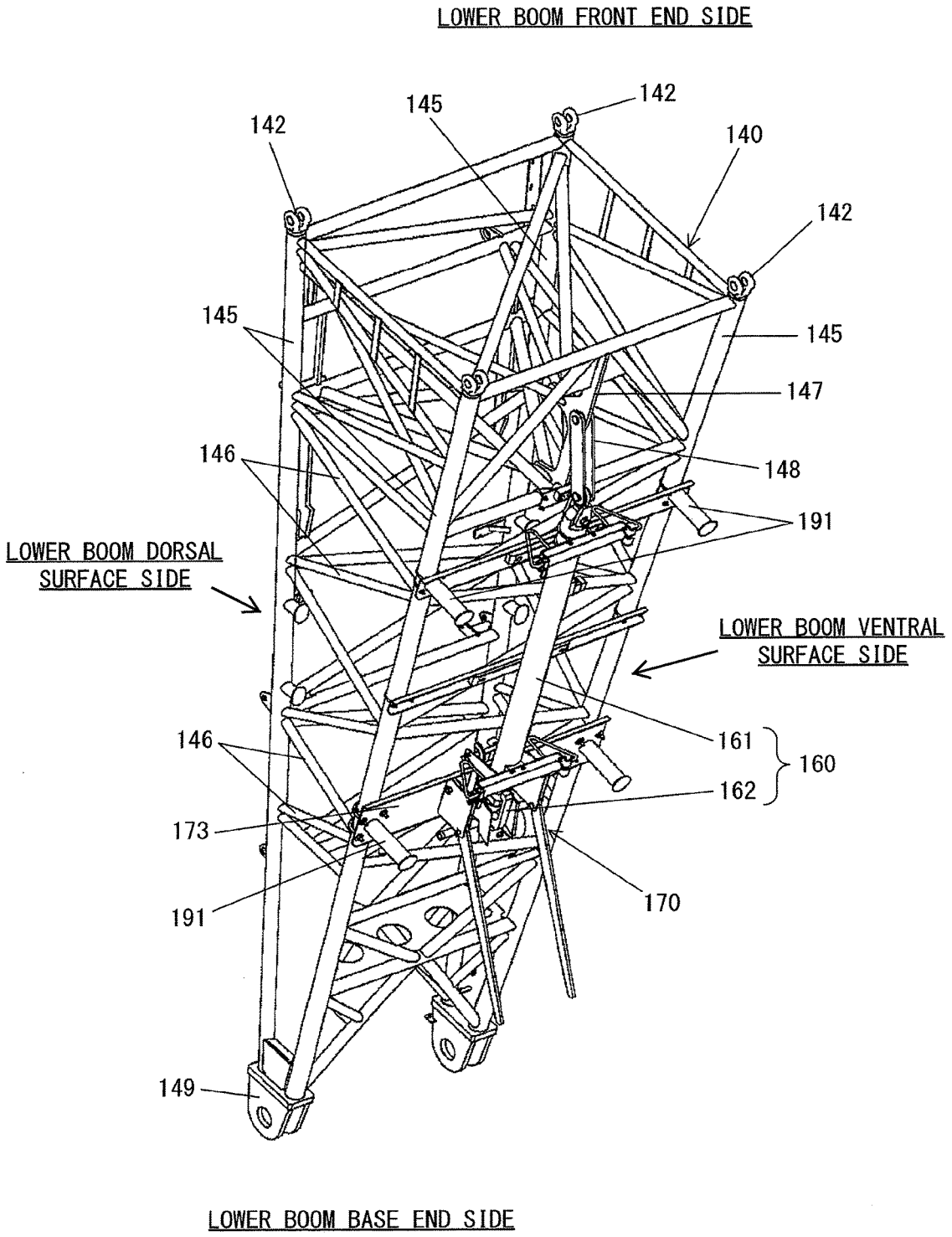
FIG. 4 is a perspective, providing an external view of a boom device.

In the embodiment, the cylinder retraction system 170, which moves the hydraulic cylinder 160 between the retracted attitude (see FIG. 1) and an operating attitude (see FIG. 2), is mounted at the lower boom 140. FIG. 4 is a perspective providing an external view of the boom device, taken from below (from the ventral surface side). As FIG. 4 shows, the boom device includes the lower boom 140, the hydraulic cylinder 160 and the cylinder retraction system 170.

The lower boom 140 assumes a lattice structure achieved by welding a plurality of support pipes 146 to four frame pipes 145 in a lattice formation. At a base end area of the lower boom 140, linking portions 149, each axially supported by the revolving upper superstructure 103, are present, whereas at a front end area of the lower frame 140, coupling portions 142 where the lower boom 140 is coupled with the upper boom 141 are present. On the ventral surface side of the lower boom 140, four leg portions 191, which will allow the lower boom 140 to be set on the ground, are disposed. The leg portions 191 located on the base end side of the lower boom 140 are welded to a mounting plate 173 of the cylinder retraction system 170, which will be described in detail later.

A bracket 147 is bonded to the ventral surface side of the lower boom 140 at a position close to the front end thereof. The upper end of the cylinder tube 161 in the hydraulic cylinder 160 is linked, via a link 148, to the bracket 147.

Figure 5:
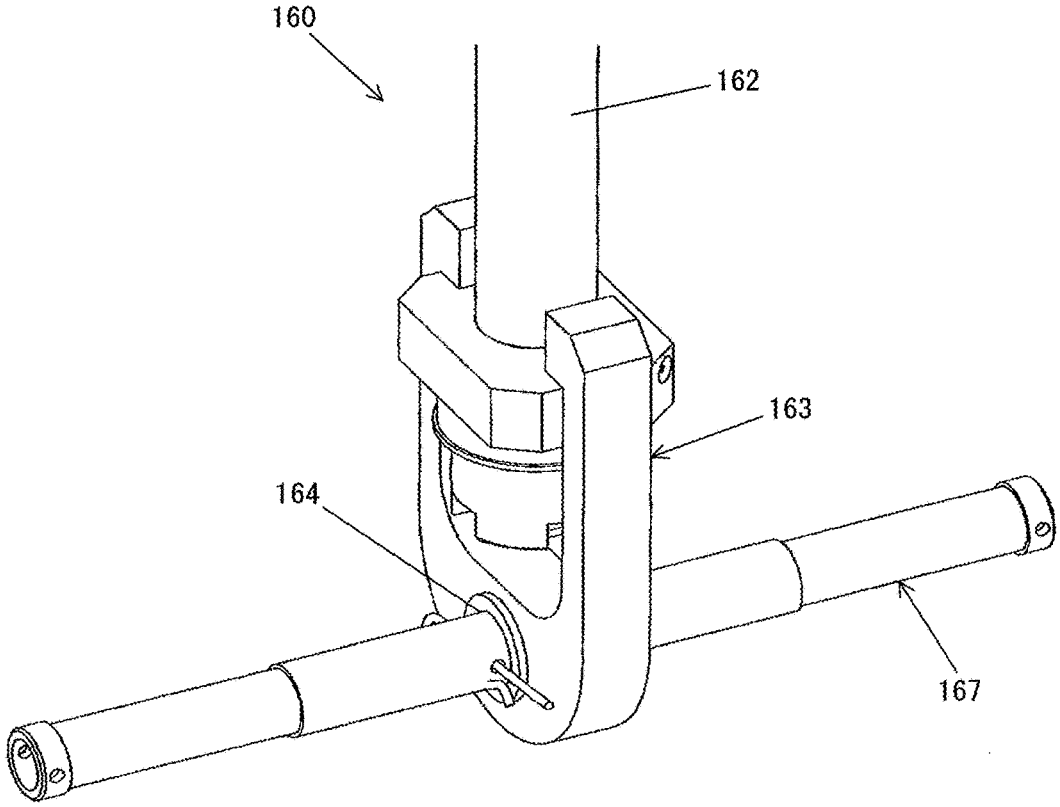
FIG. 5 shows the front end of the rod in the hydraulic cylinder.

FIG. 5 shows the front end of the rod 162 in the hydraulic cylinder 160. As shown in FIG. 5, a guide pin 167 assuming the shape of a circular column, which is to engage with guide plates 171 in the cylinder retraction system 170 to be described later, is disposed at the front end of the rod 162 in the hydraulic cylinder 160. The guide pin 167 is inserted through the through hole 164 at the mounting fixture 163 and is set so as to extend perpendicular to the rod 162.

Figure 6:
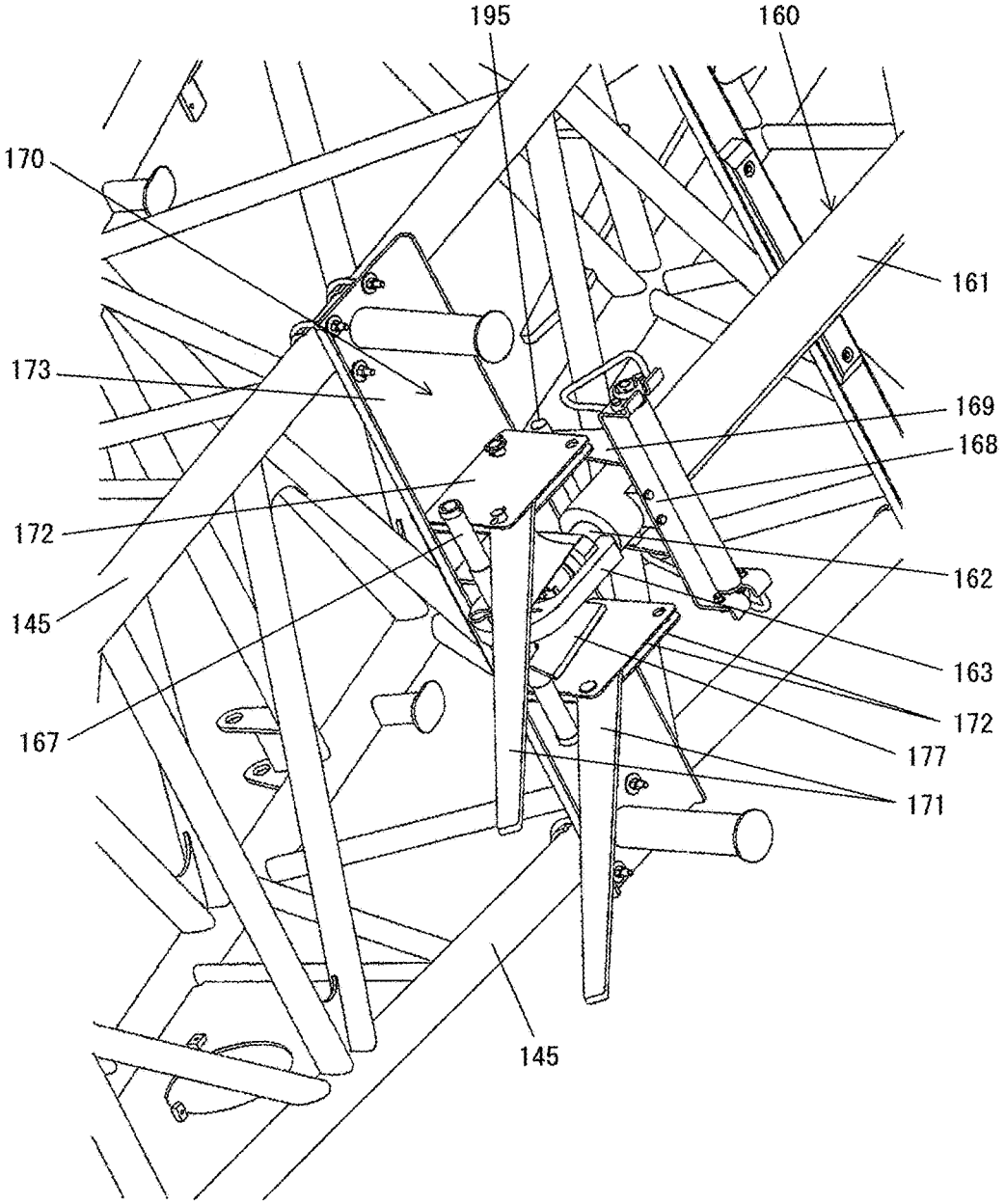
FIG. 6 shows a cylinder retraction system mounted at the lower boom, with the guide plates set at the operating positions.
Figure 7:
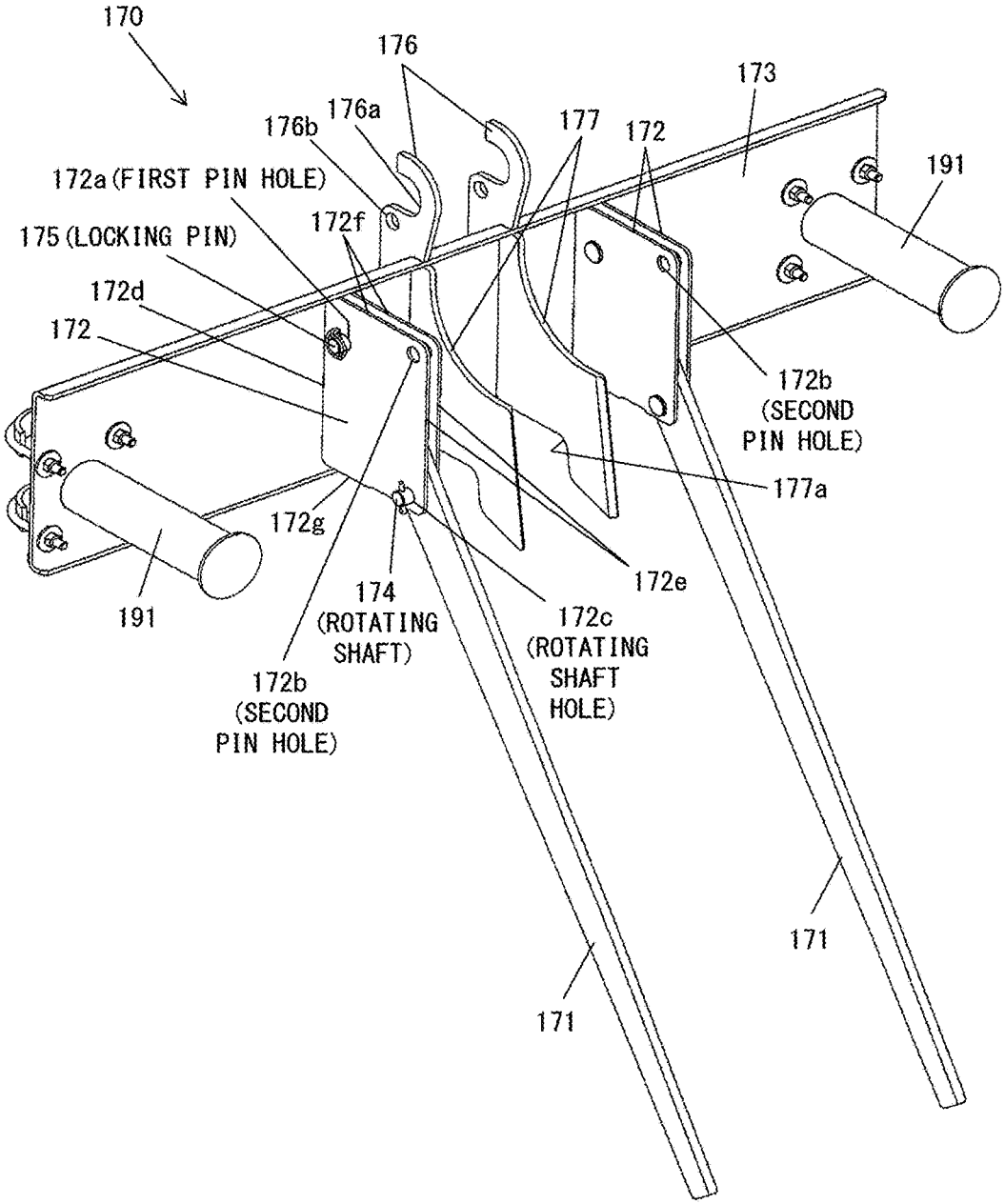
FIG. 7 shows the cylinder retraction system with the guide plates thereof set at the operating positions.

FIG. 6 shows the cylinder retraction system 170 attached to the lower boom 140 with the guide plates 171 set at the operating positions. FIG. 7 also shows the cylinder retraction system 170 with the guide plates 171 assuming the operating positions. As FIG. 6 and FIG. 7 illustrate, the cylinder retraction system 170 is configured with the mounting plate 173 locked to the lower boom 140, support plates 172 locked to the mounting plate 173 and the guide plates 171 axially supported at the support plates 172.

The mounting plate 173 includes a rectangular flat plate portion and bent portions formed by bending the two longer sides of the flat plate portion. The mounting plate 173, ranging so as to bridge a pair of frame pipes 145 located on the ventral surface side of the lower boom 140, is locked to the frame pipes 145 via fastening members such as U-bolts and nuts.

A pair of support plates 172 is disposed on each of the two sides of the hydraulic cylinder 160. The two support plates 172 in each pair disposed on either side of the hydraulic cylinder 160 range parallel to each other with a clearance wide enough to allow a guide plate 171 to be inserted between the two support plates 172.

As FIG. 7 shows, the four support plates 172 are formed in matching shapes. The support plates 172 are each formed as a flat plate member that includes an inner side edge portion 172*d* and an outer side edge portion 172*e* running parallel to each other, and a front end side edge portion 172*f* and a base end side edge portion 172*g* both running perpendicular to the inner side edge portion 172*d* and the outer side edge portion 172*e*.

The inner side edge portion 172*d* of each support plate 172 is welded to the flat plate portion of the mounting plate 173. In the vicinity of the area where the base end side edge portion 172*g* and the outer side edge portion 172*e* connect with each other at the support plate 172, a rotating shaft hole 172*c* is formed, through which a rotating shaft 174 is inserted. In the vicinity of the area where the inner side edge portion 172*d* and the front end side edge portion 172*f* connect with each other at the support plate 172, a first pin hole 172*a* through which a locking pin 175 is inserted, is formed. In the vicinity of the area where the outer side edge portion 172*e* and the front end side edge portion 172*f* connect with each other at the support plate 172, a second pin hole 172*b* through which the locking pin 175 is inserted, is formed. The first pin hole 172*a* and the second pin hole 172*b* are formed so as to achieve matching diameters.

As FIG. 6 shows, the pair of guide plates 171 are disposed over a predetermined distance from each other so as to hold the rod 162 in the hydraulic cylinder 160 between them. As shown in FIG. 7, the two guide plates 171 are formed in identical shapes. The guide plates 171 are each formed as an elongated flat plate, the base end side of which is inserted between a pair of support plates 172. The rotating shaft 174 is inserted at a position set apart from the base end of the guide plate toward the front end side by a predetermined distance, and the guide plate 171 is supported by the support plates 172 via the rotating shaft 174. Although not shown, a pin hole is formed near the base end of the guide plate 171 and when the locking pin 175 is not inserted through this pin hole, the guide plate 171 is allowed to rotate around the rotating shaft 174.

Figure 8:
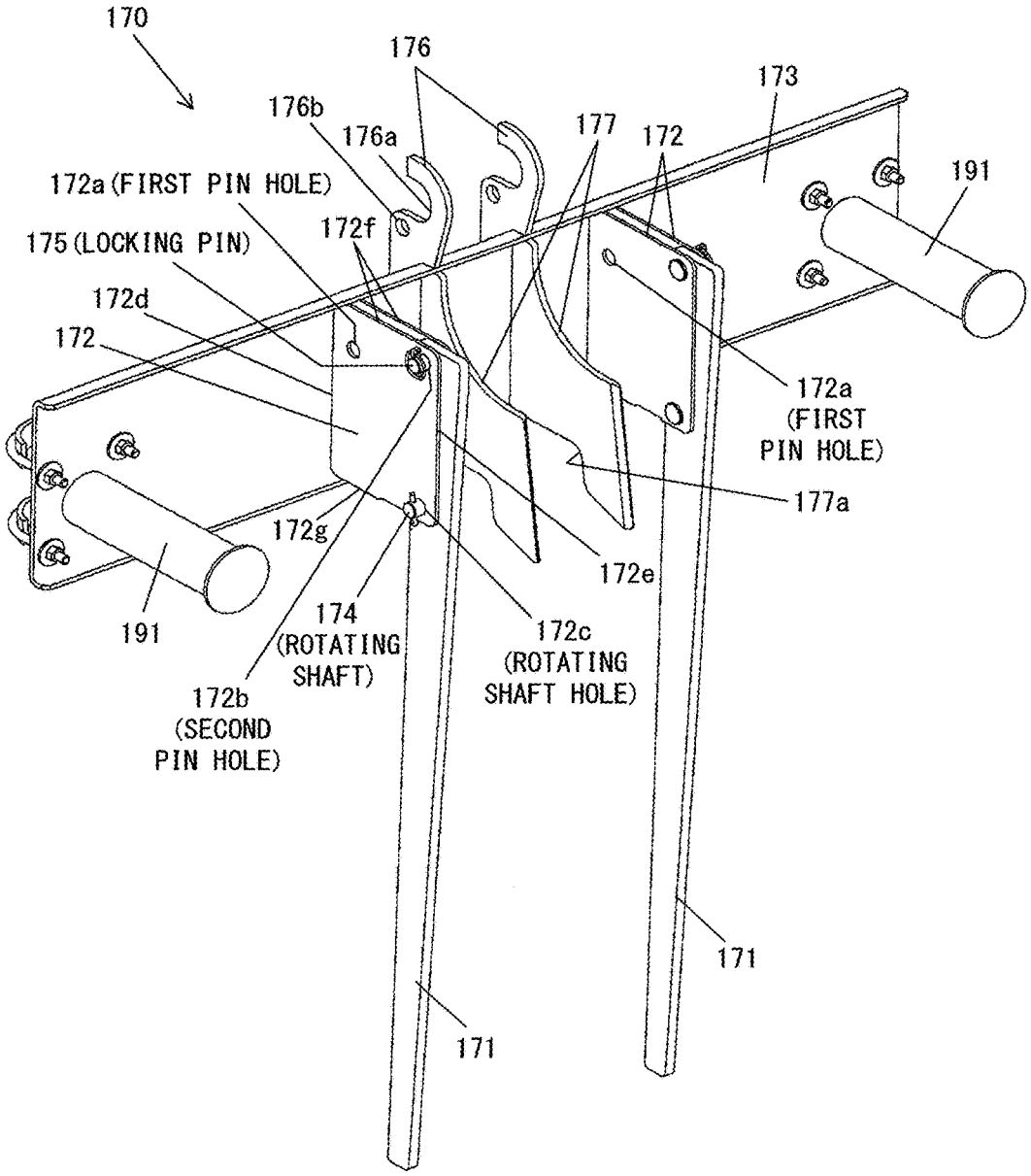
FIG. 8 shows the cylinder retraction system with the guide plates thereof set at the retracted positions.
Figure 9:
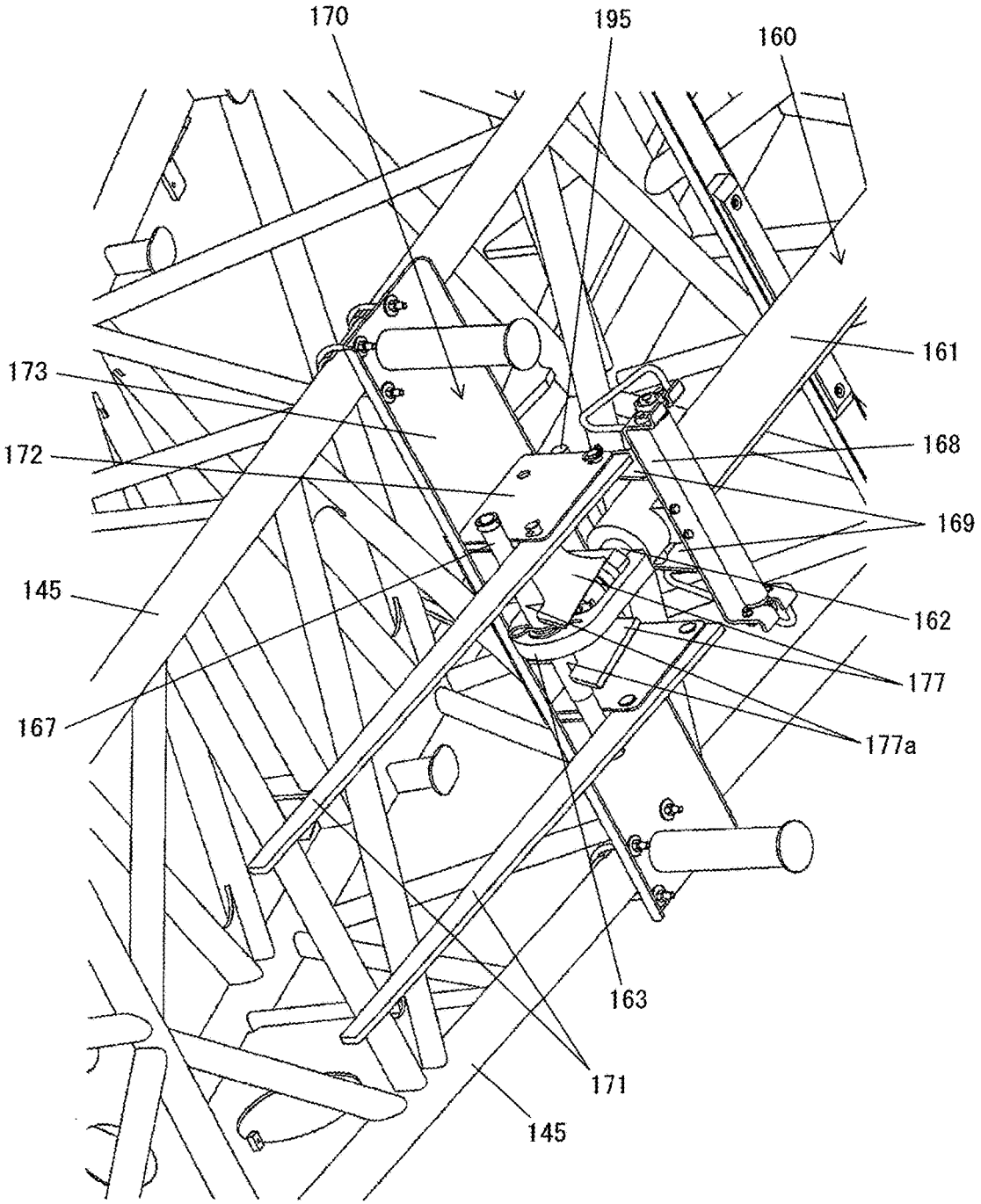
FIG. 9 shows the cylinder retraction system mounted at the lower boom, with the guide plates set at the retracted positions.

FIG. 8 shows the cylinder retraction system 170 with the guide plates 171 set at the retracted positions, whereas FIG. 9 shows the cylinder retraction system 170 attached to the lower boom 140 with the guide plates 171 set at the retracted positions. As FIGS. 8 and 9 show, once the locking pins 175 are inserted through the second pin holes 172*b* and the pin holes (not shown) formed near the base ends of the guide plates 171, the guide plates 171 are no longer allowed to rotate around the rotating shafts 174. The positions assumed by the guide plates 171 in this state will be referred to as the retracted positions. When the crane is engaged in work operation, the guide plates 171 are held in the retracted positions. As shown in FIG. 9, the guide plates 171 assuming the retracted positions extend substantially parallel to the frame pipes 145 located on the ventral surface side of the lower boom 140 with the front ends of the guide plates 171 placed in close proximity to the ventral surface of the lower boom 140.

As illustrated in FIG. 6 and FIG. 7, once the locking pins 175 are inserted through the first pin holes 172*a* and the pin holes (not shown) formed near the base ends of the guide plates 171, the guide plates 171 are no longer allowed to rotate around the rotating shafts 174. The positions taken by the guide plates 171 in this state will be referred to as the operating positions. When the crawler side frames 112 are mounted or dismounted, the guide plates 171 are locked at the operating positions. The angle formed by each guide plate 171 set at the operating position and the frame pipes 145 located on the ventral surface side of the lower boom 140 is approximately 30° to 40° (see FIG. 2). In other words, the front ends of the guide plates 171 at the operating positions are set over a greater distance from the ventral surface of the lower boom 140 compared to the distance between the front ends of the guide plates 171 assuming the retracted positions and the ventral surface of the lower boom 140. As shown in FIG. 6, the guide pin 167 disposed at the front end of the rod in the hydraulic cylinder 160 ranges so as to bridge the pair of guide plates 171.

As FIG. 7 shows, a pair of rod holding plates 177 are disposed between the pair of guide plates 171. The rod holding plates 177 each include a receiving portion 177*a* that comes into contact with the guide pin 167 when the rod 162 in the hydraulic cylinder 160 is contracted to the maximum extent. The rod holding plates 177 are members that bear the load of the hydraulic cylinder 160 when the lower boom 140 is laid down (see FIG. 10) or when the lower boom 140, set on the ground, for instance, assumes a substantially horizontal orientation.

As shown in FIG. 7, on the side of the mounting plate 173 toward the front end of the lower boom 140, a pair of retainer plates 176 are disposed so as to extend from the mounting plate 173 toward the front end of the lower boom 140. The retainer plates 176 each assume a hook shape that includes a recessed portion 176*a* formed by opening up the side toward the dorsal surface of the lower boom 140. A pin holding hole 176*b* through which a lock pin 195, which will be described later, is inserted when not in use, is formed at each retainer plate 176.

As shown in FIG. 6, a mounting member 168 is disposed so as to extend perpendicular to the hydraulic cylinder 160 at the surface of the cylinder tube 161 of the hydraulic cylinder 160 located on the side opposite from the ventral surface side of the lower boom 140. A locking plate 169 is disposed at each of the two end regions of the mounting member 168 in the lengthwise direction. At the locking plate 169, disposed so as to project out from the mounting member 168 toward the lower boom 140, a hole (not shown), through which the lock pin 195 is inserted, is formed in an area close to the front end thereof.

When the crane is engaged in work operation, the lock pin 195 is inserted through the holes (not shown) formed in the vicinity of the front ends of the locking plates 169 and through the recessed portions 176*a* (see FIG. 7) of the retainer plates 176. Thus, even if an operation for extending the rod 162 in the hydraulic cylinder 160 is erroneously performed while the crane is engaged in work operation or the like, the hydraulic cylinder 160 remains in place instead of being dislodged.

When the crawler side frames 112 are ready to be mounted or dismounted, the lock pin 195 is disengaged from the recessed portions 176*a* of the retainer plates 176. Once the lock pin 195 is disengaged, the hydraulic cylinder 160 is allowed to swing relative to the lower boom 140. During the crawler side frame mount/dismount operation that does not require the use of the lock pin 195, the lock pin 195 is inserted through the pin holding holes 176*b* (see FIG. 7) at the two retainer plates 176 so as to range over the pair of retainer plates 176. Since the lock pin 195 is held by the retainer plates 176 when it is not in use, misplacement of the lock pin 195 can be effectively prevented. Since the pin holding holes 176*b* are formed near the recessed portions 176*a*, the lock pin 195 can be disengaged and inserted through the pin holding holes 176*b* with ease.

In reference to FIGS. 10 through 16, the operational sequence through which the crane 100 is assembled will be described. It is to be noted that an illustration of the structural elements used for purposes of derricking the lower boom 140 is not included in each figure, and that the outline of the body is schematically indicated with 2-point chain lines in FIGS. 10 through 13 and FIG. 15. The crane is transported to a work site with the revolving upper superstructure 103, the car body 111 linked to the revolving upper superstructure 103, the lower boom 140, the upper boom 141 and the crawler side frames 112 disengaged.

Figure 10:
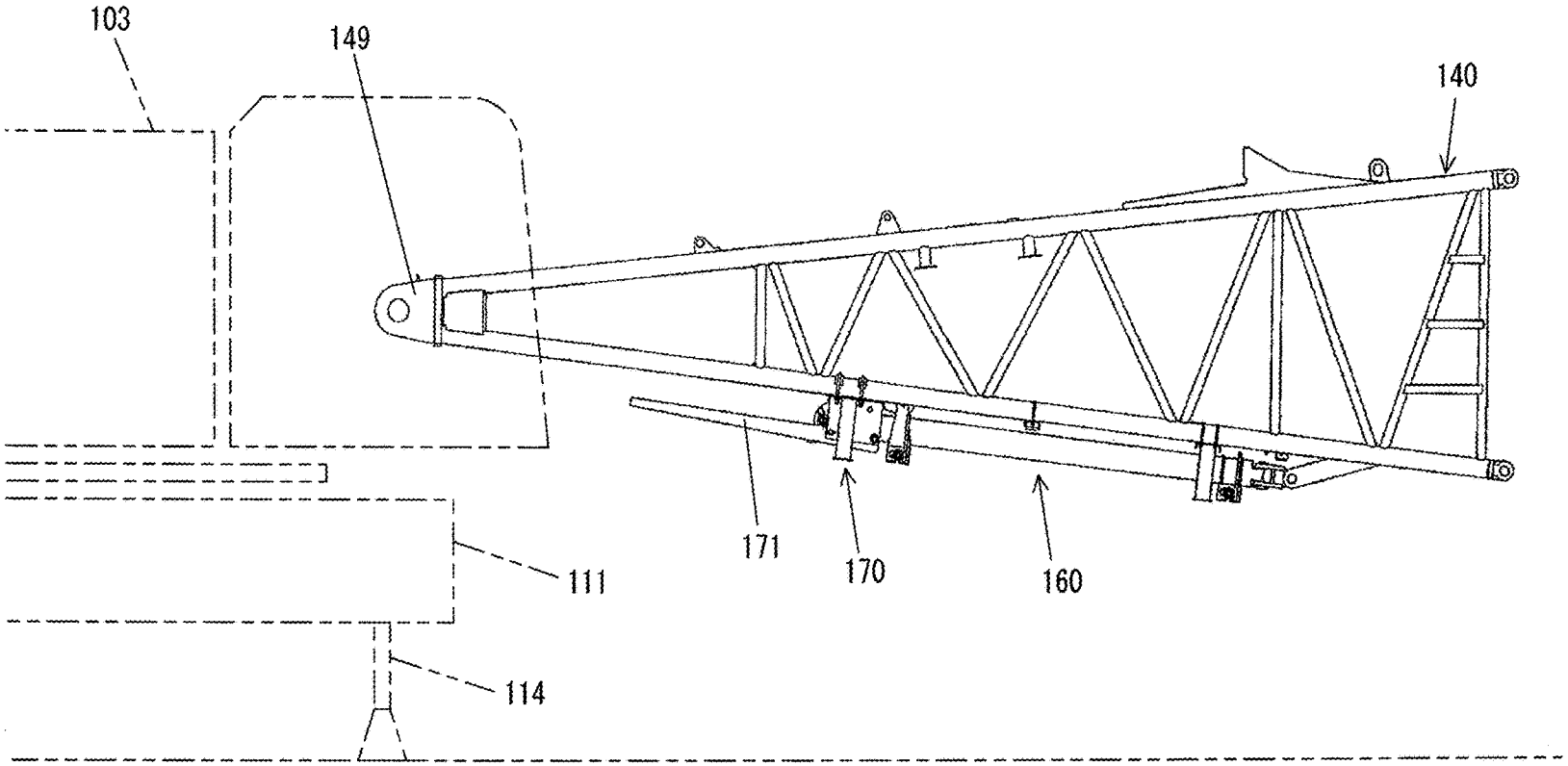
FIG. 10 shows the lower boom set in a substantially horizontal orientation with the guide plates set at the retracted positions.

(1) At the work site, the revolving upper superstructure 103 and the car body 111 are supported by the jack-up cylinders 114 disposed at the car body 111, as shown in FIG. 10. The revolving upper superstructure 103 is rotated by 90° relative to the car body 111.

(2) The linking portions 149 of the lower boom 140 are attached to the revolving upper superstructure 103, as shown in FIG. 10. It is to be noted that during transportation, the guide plates 171 in the cylinder retraction system 170 are locked at the retracted positions (see FIGS. 8 and 9) with the lock pin 195 inserted through the recessed portions 176*a* (see FIG. 8) at the retainer plates 176 and the holes (not shown) formed near the front ends of the locking plates 169.

The following is a description of the preparatory operation that must be performed before the crawler side frames 112 are mounted.

(3) As shown in FIG. 10, the lower boom 140 is held in a substantially horizontal orientation.

Figure 11:
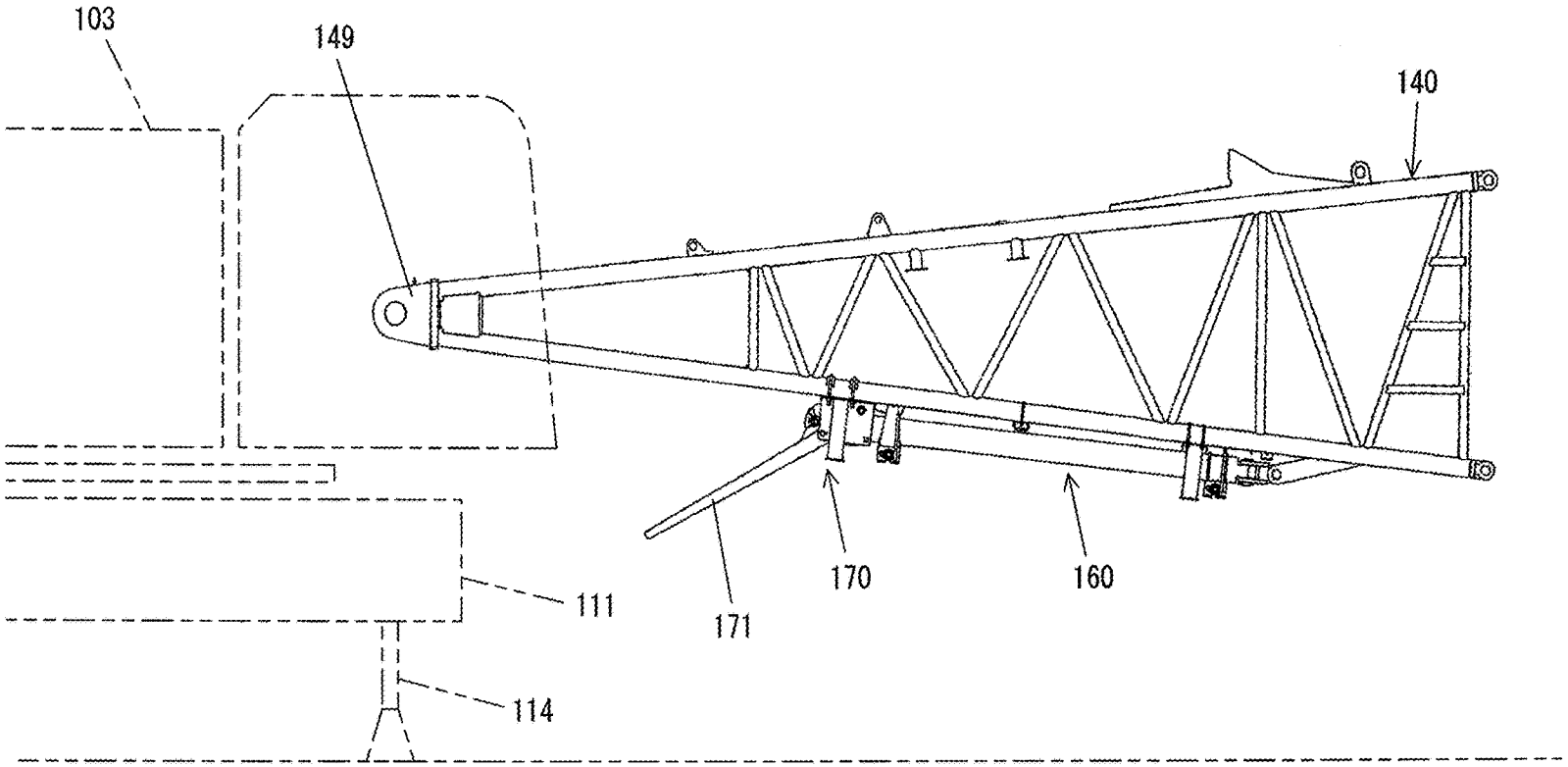
FIG. 11 shows the lower boom set in a substantially horizontal orientation with the guide plates set at the operating positions.

(4) The locking pins 175 are disengaged from the holes (not shown) located near the base end side of the guide plates 171 and the second pin holes 172*b* (see FIG. 8) and then the guide plates 171 are each rotated by a predetermined angle around the respective rotating shaft 174. The locking pins 175 are inserted through the holes (not shown) located near the base end side of the guide plates 171 and the first pin holes 172*a* (see FIG. 7). As a result, the guide plates 171 become locked at the operating positions, as shown in FIG. 11.

The lock pin 195 is disengaged from the recessed portions 176*a* (see FIG. 7) of the retainer plates 176 and the holes (not shown) formed near the front ends of the locking plates 169, and the lock pin 195 having been disengaged is then inserted through and locked at the pin holding holes 176*b* at the retainer plates 176.

Figure 12:
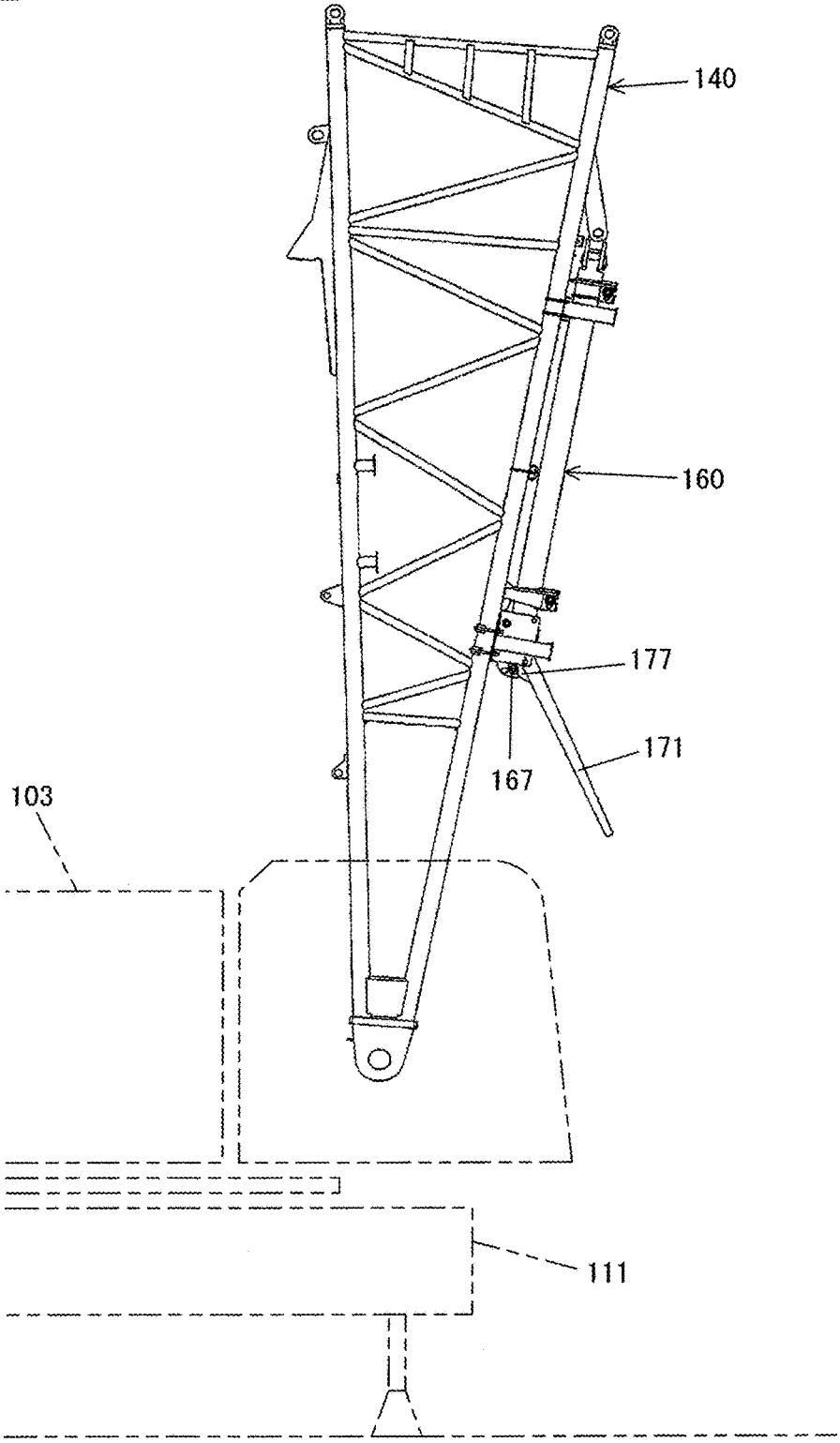
FIG. 12 shows the lower boom set in a substantially vertical orientation with the hydraulic cylinder assuming a retracted attitude.

(6) As shown in FIG. 12, the lower boom 140 is raised to the upper angle limit so as to orient the lower boom 140 substantially vertically.

Figure 13:
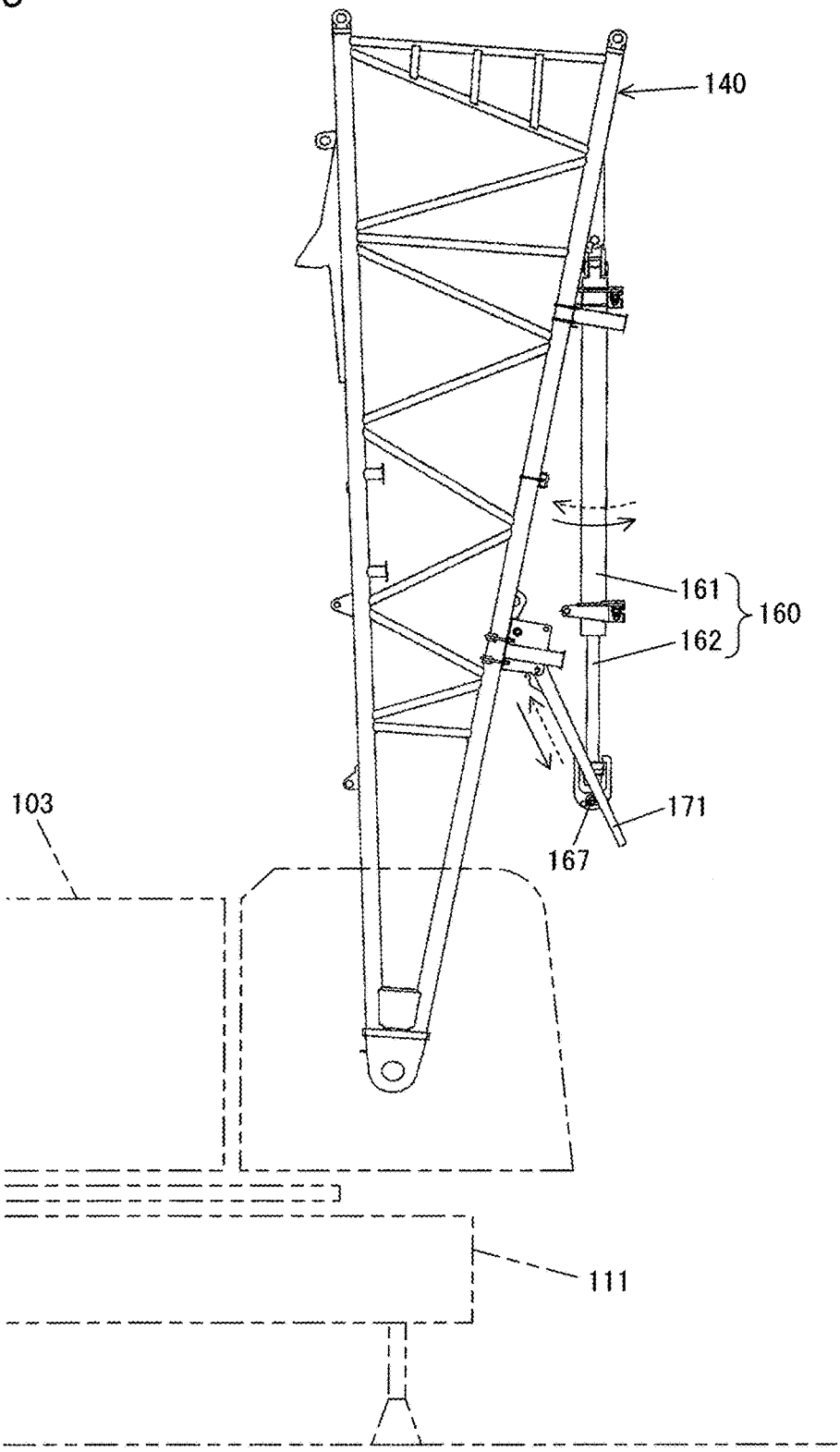
FIG. 13 illustrates how the rod in the hydraulic cylinder is extended/contracted.
Figure 14:
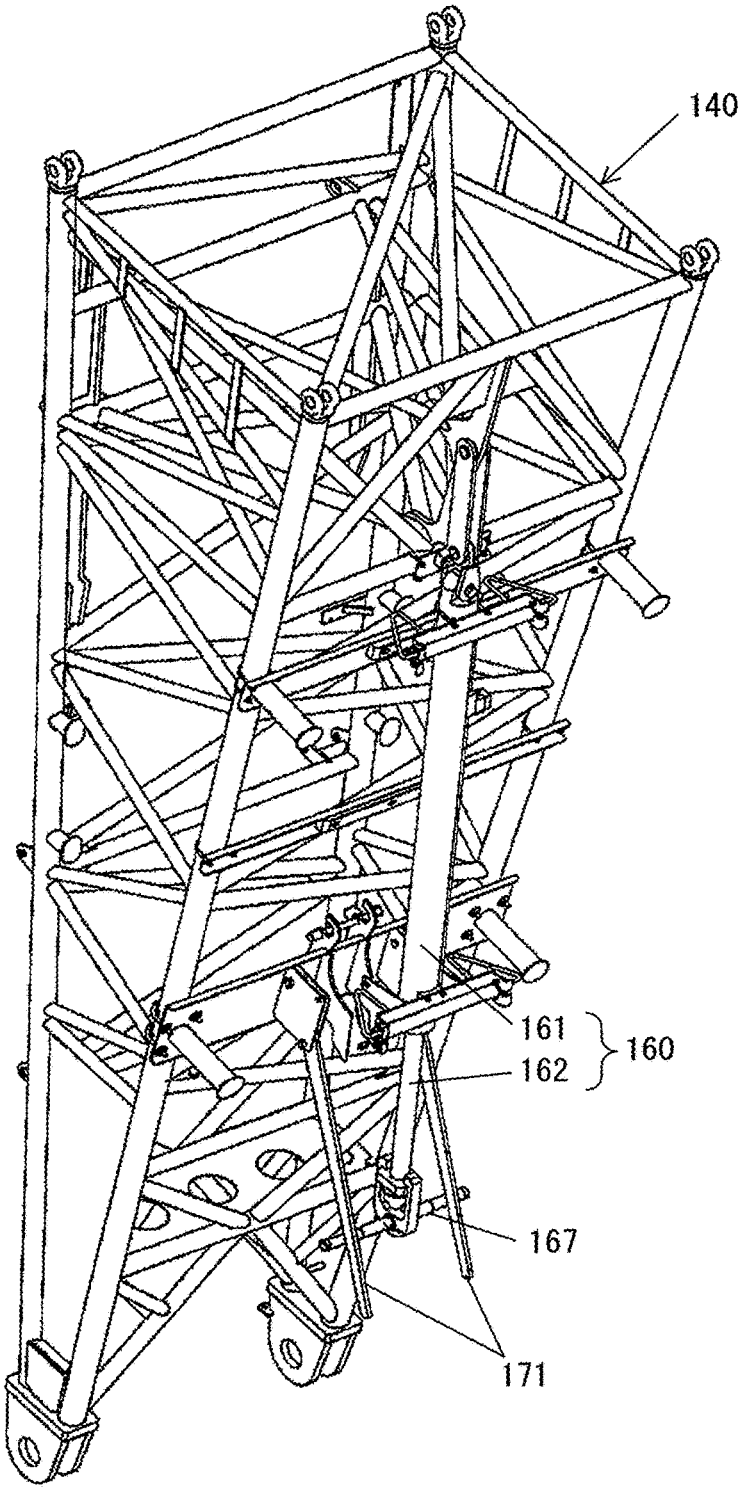
FIG. 14 shows the boom device in FIG. 13 in a perspective view.

(7) As the rod 162 in the hydraulic cylinder 160 is extended, the front end of the rod is guided via the guide plates 171 toward the front ends of the guide plates 171 (see the solid line straight arrow in FIG. 13). Since the upper end of the hydraulic cylinder 160 is attached to the lower boom 140 so that the hydraulic cylinder 160 is allowed to swing relative to the lower boom 140, the hydraulic cylinder 160 is caused by its own weight to swing away from the lower boom 140 as the rod 162 extends (see the solid line curved arrow in FIG. 13). It is to be noted that the rotational angle of the hydraulic cylinder 160 is restricted as the guide pin 167 located at the rod front end becomes engaged or comes in contact with the guide plates 171.

Figure 15:
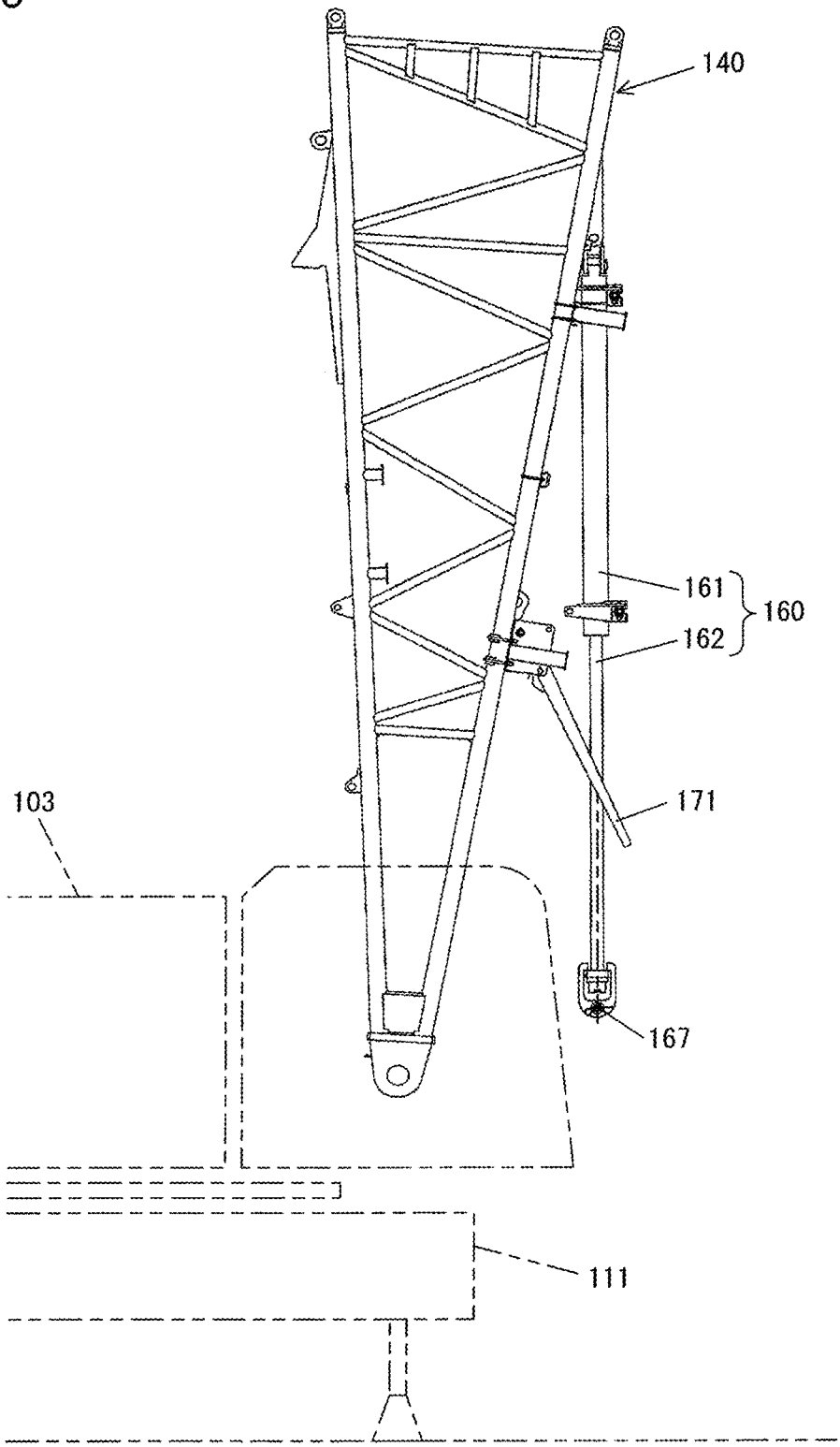
FIG. 15 illustrates a condition in which the hydraulic cylinder assumes the operating attitude.
Figure 16:
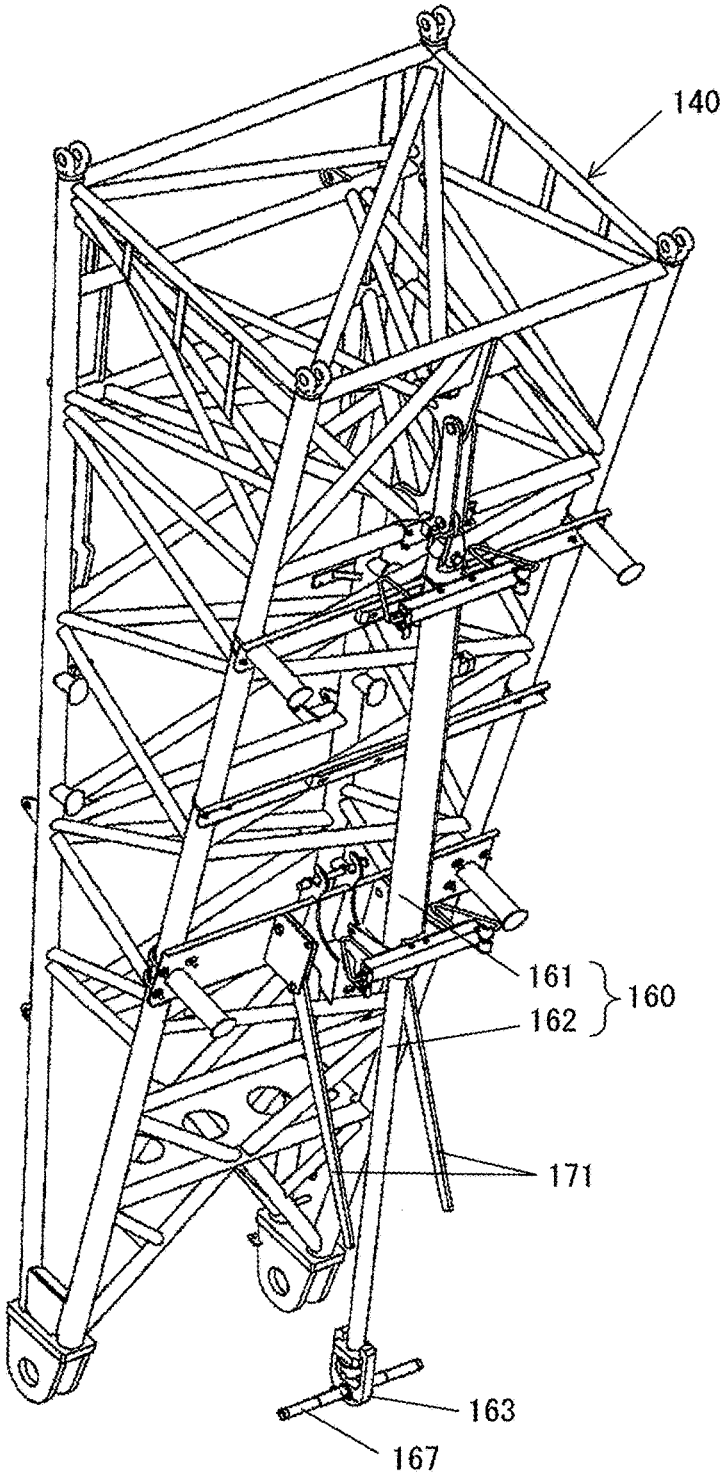
FIG. 16 shows the boom device in FIG. 15 in a perspective view.

(8) When the rod 162 is extended by a predetermined extent, the hydraulic cylinder 160 is set parallel to the vertical direction. As the rod 162 is further extended, the engagement between the guide plates 171 and the guide pin 167 becomes released, thereby setting the hydraulic cylinder 160 in the operating attitude, oriented along the vertical direction, as shown in FIG. 15 and FIG. 16. The guide pin 167 is then disengaged from the through hole 164 at the mounting fixture 163 disposed at the hydraulic cylinder 160 (see FIG. 5), and the shackle 166 is attached to the mounting fixture 163 (see FIG. 3). With this, the preparatory operation to be performed prior to mounting the crawler side frames 112 is completed.

(9) The suspension rope 199 is attached to the shackle 166 and a crawler side frame 112 (see FIG. 2), the hydraulic cylinder 160 and the lower boom 140 are engaged in operation to move the crawler side frame 112 to the predetermined mounting position at the car body 111, and the crawler side frame 112 is mounted on the car body 112, as has been described earlier. Once the crawler side frames 112 are mounted on both sides the jack-up cylinders 114 are contracted, the crawler tracks 113 are set on the ground, and thus, the mounting operation for the crawler side frames 112 is completed.

The following is a description of an operation performed when retracting the crawler side frame mount/dismount device.

(10) The shackle 166 (see FIG. 3) is disengaged by pulling out the bolt 165 from the through hole 164 in the mounting fixture 163 at the hydraulic cylinder 160 and the guide pin 167 is attached at the mounting fixture 163 (See FIG. 5).

(11) As shown in FIG. 15 and FIG. 16, the lower boom 140 is raised to the upper angle limit so as to set the lower boom 140 in a substantially vertical orientation. By orienting the lower boom 140 in this manner, the front end portions of the guide plates 171 can be positioned directly above the guide pin 167, i.e., on a vertical line (see the 1-point chain line in FIG. 15).

(12) As the rod 162 in the hydraulic cylinder 160 is contracted to a predetermined extent, the guide pin 167 becomes engaged at areas near the front end portions of the guide plates 171. As the rod 162 in the hydraulic cylinder 160 is contracted to an even greater extent, the guide pin 167 at the rod front end is guided by the pair of guide plates 171 toward the base ends of the guide plates 171 (see the dotted line straight arrow in FIG. 13). Since the upper end of the hydraulic cylinder 160 is mounted at the lower boom 140 so that the hydraulic cylinder 160 is allowed to swing, the hydraulic cylinder 160 swings toward the ventral surface of the lower boom 140, i.e., closer to the lower boom 140 (see the dotted line curved arrow in FIG. 13) as the rod 162 contracts.

(13) When the rod 162 in the hydraulic cylinder 160 is contracted to the maximum extent, the guide pin 167 reaches the receiving portions 177*a* of the rod holding plates 177 (see FIG. 7) and thus, the hydraulic cylinder 160 assumes the retracted attitude.

(14) As shown in FIG. 11, the lower boom 140 is lowered until it is oriented substantially horizontally.

(15) The locking pins 175 are disengaged from the holes (not shown) formed near the base end side of the guide plates 171 and the first pin holes 172*a* (see FIG. 7), and the guide plates 171 are rotated by a predetermined angle around the rotating shafts 174. The locking pins 175 are then inserted through the holes (not shown) formed near the base end side of the guide plates 171 and through the second pin holes 172*b* (see FIG. 8). As a result, the guide plates 171 become locked at the retracted positions (see FIG. 9), as illustrated in FIG. 10.

(16) The lock pin 195 is disengaged from the pin holding holes 176*b* (see FIG. 8) at the retainer plates 176 and the lock pin 195 thus disengaged is then inserted through the recessed portions 176*a* of the retainer plates 176 and the holes (not shown) formed near the front ends of the locking plates 169 (see FIG. 9). With this, the retracting operation performed to retract the crawler side frame mount/dismount device is completed.

(17) Subsequently, the upper boom 141 is linked to the lower boom 140, the hoisting rope 105*a* is wound at the sheaves located at the front end of the upper boom 141, the hook 110 is connected to the front end of the hoisting rope 105*a* and thus, the crane 100 is set in the work attitude (see FIG. 1) as has been described earlier.

The cylinder retraction system 170 achieved in the embodiment as described above is a system that causes the crawler side frame hoisting hydraulic cylinder 160, swingably suspended on the ventral surface side of the lower boom 140, to swing between the retracted attitude (see FIGS. 10 through 12) in which it ranges along the ventral surface of the lower boom 140 and the operating attitude (see FIG. 15) in which it is oriented along the vertical direction. The cylinder retraction system 170 includes the guide plates 171, the base ends of which are attached to the ventral surface side of the lower boom 140 and the front ends of which are set away from the ventral surface of the lower boom 140. The guide plates 171 are engaged with the guide pin 167 disposed at the front end of the rod in the hydraulic cylinder 160 so as to guide the front end of the rod in the hydraulic cylinder 160 as the hydraulic cylinder 160 extends/contracts (See FIG. 13).

The following advantages are achieved through the embodiment described above.

(1) The cylinder retraction system 170 is structured so that as the rod 162 in the hydraulic cylinder 160 currently assuming the operating attitude is made to contract by a predetermined extent, the front end of the hydraulic cylinder 160 is guided via the guide plates 171 until the hydraulic cylinder 160 takes on the retracted attitude and that as the hydraulic cylinder 160 currently assuming the retracted attitude is extended by a predetermined extent, the engagement between the front end of the hydraulic cylinder 160 and the guide plates 171 is released to allow the hydraulic cylinder 160 to take on the operating attitude. Such a cylinder retraction system 170 makes it possible to perform the preparatory operation before mounting the crawler side frames 112 at the car body 111 and retract the controller side frame mount/dismount device with great ease and thus assures a high level of operability.

(2) In the related art, the front end of the rod 162 in the hydraulic cylinder 160 is connected with the lower boom 140 via a belt sling or a rope sling, and the rod 162 is contracted so as to lock the hydraulic cylinder 160 to the lower boom 140 (hereafter referred to as the prior art technology). The prior art technology, in which the hydraulic cylinder 160 is placed at a position set apart from the lower boom 140 by a certain distance, gives rise to a concern that depending upon the work attitude assumed by the crane 100, the hydraulic cylinder 160 may interfere with the hook 110 or the hoisting rope 105*a* during crane operation. For this reason, the operator must pay close attention in order to avoid interference, and thus, the work efficiency tends to be compromised. The hydraulic cylinder 160 assuming the retracted attitude is placed in its entirety in close proximity to the lower boom 140 so as to range along the frame pipes 145 located on the ventral surface side of the lower boom 140 in the embodiment. Thus, the hydraulic cylinder 160 never interferes with the hook 110 or the hoisting rope 105*a* while the crane is engaged in work operation. As a result, the operator does not need to pay any special attention to avoid interference between the hydraulic cylinder 160 and the book 110 or the like during crane operation. In other words, the embodiment reduces the work onus on the operator during crane operation, assuring improvement in work efficiency.

(3) In the prior art technology, a significant tensile force is required to set the hydraulic cylinder 160 in close proximity to the ventral surface of the lower boom 140 with a sling. This means that the prior art technology gives rise to a concern that when contracting the rod 162 to set the hydraulic cylinder 160 in close proximity to the lower boom 140, the hydraulic cylinder 160 and the sling are bound to be subjected to an excessive load and the connecting portions of the lower boom 140 where it is connected with the hydraulic cylinder and the sling may become damaged. In contrast, the hydraulic cylinder 160 in the embodiment is held in the retracted attitude by the cylinder retraction system 170, and thus, damage to the lower boom 140 and the like is effectively prevented.

(4) The base ends of the guide plates 171 are axially supported on the side where the lower boom 140 is located so as to allow the guide plates 171 to rotate between the retracted positions (see FIG. 8), at which the front ends of the guide plates 171 are set in close proximity to the lower boom 140, and the operating positions (see FIG. 7), at which the front ends are set apart from the ventral surface of the lower boom 140. Thus, by setting the guide plates 171 at the retracted positions during crane operation, it is ensured that the hook 110 or the hoisting rope 105*a* never interfere with the guide plates 171.

(5) In the prior art technology, a worker needs to climb up to a position above the ground in order to attach or detach the sling attached to the rod front end in the hydraulic cylinder 160 to/from the lower boom 140. In contrast, the embodiment allows the guide plates 171 to be switched between the retracted positions and the operating positions on the ground and allows the hydraulic cylinder 160 to be switched between the retracted attitude and the operating attitude by the operator remaining in the driver's seat. Thus, no worker has to work at a high place.

(6) In a crane in the prior art technology equipped with a reeving winch mounted near the base end of the lower boom 140, the operator engaged in reeving operation, performed to wind the hoisting rope 105*a* through the sheaves disposed at the front end of the boom 104 and hook sheaves via the reeving winch, needs to pay close attention to avoid interference between the hydraulic cylinder 160 and the reeving rope wound at the reeving winch. The embodiment, in which the hydraulic cylinder 160 is disposed in close proximity to the lower boom 140, is distinguishable in that the risk of interference between the reeving rope and the hydraulic cylinder 160 is eliminated and better reeving operability is thus assured.

The following variations are also within the scope of the present invention and one of the variations or a plurality of variations may be adopted in combination with the embodiment described above.

(1) The angle formed by each guide plate 171 assuming the operating position and the ventral surface of the lower boom 140 is approximately 30° to 40° in the description provided above. However, the present invention is not limited to this example, as long as it is assured that the guide pin 167 disposed at the front end of the rod 162 in the hydraulic cylinder 160 engages or contacts with the guide plates 171 as the rod 162 in the hydraulic cylinder 160 is contracted while the lower boom 140 is raised at a predetermined angle.

(2) While the cylindrical guide pin 167 is set so as to bridge over the pair of guide plates 171 in the embodiment described above, the present invention is not limited to this example. For instance, a guide pin disposed at the rod front end may be made to engage with a single guide plate. In addition, a guide pin 167 assuming a shape other than that of a cylindrical column may be used. In addition, instead of the guide pin 167, a projecting portion may be formed at the rod front end so as to engage the projecting portion with the guide plates. The guide plates 171, functioning as guiding portions, do not need to assume an elongated rectangular shape. Alternatively, shaft members may be used as the guiding portions that engage with the front end of the rod.

As long as the features characterizing the present invention remain intact, the present invention is in no way limited to the particulars of the embodiments described above and other aspects that are conceivable within the technical scope of the present invention are also within the scope of the invention.

The embodiment of the present invention and variations thereof described above make it possible to prevent interference of the hook or the hoisting rope suspending the hook with the hydraulic cylinder during crane operation by retracting the hydraulic cylinder so that the hydraulic cylinder lies along the ventral surface of the lower boom without any risk of damage to the lower boom or the like.

What is claimed is:

1. A crawler crane comprising a traveling lower superstructure, a revolving upper superstructure rotatably disposed upon the traveling lower superstructure and a boom of which base end portion is pivotably attached to the revolving upper superstructure, the traveling lower superstructure having a car body linked to the revolving upper superstructure, a pair of crawlers detachably mounted on both sides of the car body, each of the pair of crawlers configured so as to include a crawler side frame and a crawler belt wrapped around the crawler side frame, wherein the crawler side frame is detachable to and from the car body for the crawler crane itself, comprising:

a hydraulic cylinder swingably suspended on a ventral surface side of the boom, and having a rod extended and contracted by hydraulic oil, and equipped with a mounting fixture attached at a front end of the rod for suspending the crawler side frame;

a cylinder retraction system including a pair of guide plates set apart from each other over a predetermined distance on two opposite sides of the rod, each of which base end side rotatably supported on the ventral surface side of the boom, and configured so that front edges of the pair of guide plates being rotated between a retraction portion closer to the ventral surface side of the boom and an operating position over a greater distance from the ventral surface side of the boom; wherein a through hole is formed at the mounting fixture, a round bar shaped guide pin or a shackle for suspending the crawler side frame is selectively attached to the through hole;

when the hydraulic cylinder has been disposed in vertical direction in a condition in which the round bar shaped guide pin has been inserted through the through hole to assume an operating attitude, and the hydraulic cylinder has been made to contract in a condition in which the pair of the guide plates have been set in the operating positions, then the round bar shaped guide pin is guided via the pair of guide plates, and the hydraulic cylinder assumes the retracted attitude in which the hydraulic cylinder are disposed along the ventral surface side of the boom;

when the hydraulic cylinder has assumed the retracted attitude in a condition in which the round bar shaped guide pin has been inserted through the through hole, and the hydraulic cylinder has been made to extend in the condition in which the pair of the guide plates have been set in the operating positions, then the round bar shaped guide pin is guided via the pair of guide plates, and the hydraulic cylinder assumes the operating attitude; and when the hydraulic cylinder has assumed the operating attitude, and the round bar shaped guide pin or the shackle has been attached to the mounting fixture, the crawler side frame is made suspensible.

2. The crawler crane according to claim 1, wherein a pair of retainer plates is disposed at the ventral surface side of the boom;

a lock pin engaging with the pair of retainer plates is disposed at the hydraulic cylinder;

when the lock pin has engaged with the pair of retainer plates, the hydraulic cylinder is kept assuming the retracted attitude; and a pin holding hole for temporarily holding the lock pin at the pair of retainer plates is formed through each of the pair of retainer plates.

* * * * *